US008558762B2

(12) United States Patent
Park et al.

(10) Patent No.: US 8,558,762 B2
(45) Date of Patent: Oct. 15, 2013

(54) LIGHT EMITTING DISPLAY DEVICE

(75) Inventors: Sung-Cheon Park, Kyunggi-do (KR); Choon-Yul Oh, Kyunggi-do (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 1092 days.

(21) Appl. No.: 11/217,685

(22) Filed: Sep. 2, 2005

(65) Prior Publication Data

US 2006/0066531 A1 Mar. 30, 2006

(30) Foreign Application Priority Data

Sep. 24, 2004 (KR) ..... 2004-77007

(51) Int. Cl.
*G09G 3/30* (2006.01)

(52) U.S. Cl.
USPC ..... 345/76

(58) Field of Classification Search
USPC ..... 315/169.2, 169.3; 345/76–83, 211–213
See application file for complete search history.

(56) References Cited

U.S. PATENT DOCUMENTS

| | | | | |
|---|---|---|---|---|
| 5,929,620 | A * | 7/1999 | Dobkin et al. | 323/288 |
| 5,940,069 | A | 8/1999 | Moon | |
| 6,087,814 | A | 7/2000 | Yamasaki | |
| 6,348,906 | B1 * | 2/2002 | Dawson et al. | 345/82 |
| 6,522,191 | B1 | 2/2003 | Cha et al. | |
| 7,224,340 | B2 * | 5/2007 | Pai et al. | 345/99 |
| 7,456,810 | B2 * | 11/2008 | Kimura | 345/76 |
| 2002/0024484 | A1 * | 2/2002 | Lee et al. | 345/87 |
| 2002/0101180 | A1 * | 8/2002 | Shino | 315/169.3 |
| 2004/0095340 | A1 * | 5/2004 | Nakamura | 345/204 |
| 2004/0095342 | A1 | 5/2004 | Lee et al. | |

FOREIGN PATENT DOCUMENTS

| | | |
|---|---|---|
| CN | 1195785 | 10/1998 |
| CN | 1329388 A | 1/2002 |
| CN | 1490785 A | 4/2004 |
| CN | 1517965 | 8/2004 |
| EP | 0 858 065 | 8/1998 |
| EP | 1 441 325 | 7/2004 |
| JP | 11-225303 | 8/1999 |
| JP | 2003-295826 | 10/2003 |
| JP | 2004-226960 | 8/2004 |

OTHER PUBLICATIONS

Patent Gazette issued by the SIPO on Dec. 17, 2008 in corresponding Chinese Patent Application No. 200510106855.3.
European Office Action of the European Patent Application No. 05 10 8579, issued on Dec. 14, 2005.

(Continued)

*Primary Examiner* — Sumati Lefkowitz
*Assistant Examiner* — Robert E Carter, III
(74) *Attorney, Agent, or Firm* — Robert E. Bushnell, Esq.

(57) ABSTRACT

A light emitting display includes: a pixel portion including a plurality of pixels; a scan driver adapted to supply a scan signal to scan lines connected to the pixels; a DC/DC converter adapted to supply a first voltage and a second voltage to the plurality of pixels; and a synchronizer adapted to maintain a ripple voltage of the first voltage at a predetermined level when the scan signals are converted into a turn off voltage. With this configuration, since the ripple voltage of the first voltage is always kept constant when the scan signal is turned off, a uniform brightness in a horizontal line and a frame can be displayed.

16 Claims, 10 Drawing Sheets

(56) References Cited

OTHER PUBLICATIONS

An article "Pixel-Driving Methods for Large-Sized Poly-Si AM-OLED Displays" written by Yumoto et al., published in Asia Display, vol. Conf. 21/8, pp. 1395-1398 on Oct. 16, 2001.
An article "Current-Source a-Si: H Thin-Film Transistor Circuit for Active-Matrix Organic Light-Emitting Displays" written by Yi et al., published in IEEE Electron Device Letters, vol. 21, No. 12, pp. 590-592 on Dec. 2000.
Office action from the Japanese Patent Office issued in Applicant's corresponding Japanese Patent Application No. 2005-146997 dated Jul. 1, 2008.
Chinese Office action corresponding to Chinese Patent Application No. 200510106855.3, issued on Jun. 29, 2007.

* cited by examiner

LIGHT EMITTING DISPLAY DEVICE

CLAIM OF PRIORITY

This application makes reference to, incorporates the same herein, and claims all benefits accruing under 35 U.S.C. §119 from an application earlier filed in the Korean Intellectual Property Office on Sep. 24, 2004 and there duly assigned Serial No. 2004-77007.

BACKGROUND OF THE INVENTION

1. Field of the Invention

The present invention relates to a DC/DC converter, a light emitting display using the DC/DC converter, and a driving method thereof, and more particularly, to a DC/DC converter, a light emitting display using the DC/DC converter, and a driving method thereof, in which an image is displayed with uniform brightness.

2. Description of the Related Art

Recently, various flat panel displays have been developed, which substitute for a Cathode Ray Tube (CRT) display because the CRT display is relatively heavy and bulky. Flat panel displays include Liquid Crystal Displays (LCDs), Field Emission Displays (FEDs), Plasma Display Panels (PDPs), light emitting displays, etc.

Among the flat panel displays, the light emitting display can emit light of its own by electron-hole recombination. Such a light emitting display has advantages in that its response time is relatively fast and its voltage consumption is relatively low.

A light emitting display comprises: a pixel portion including a plurality of pixels formed adjacent to a region where a plurality of scan lines intersects a plurality of data lines; a scan driver to drive scan lines; a data driver to drive data lines; and a DC/DC converter to supply first voltage and second voltage to the pixels.

The scan driver generates scan signals and supplies the generated scan signals to the scan lines to select the pixels in units of horizontal lines in sequence.

The data driver supplies data signals to the data lines when the scan signals are supplied. As a result, as the data signals are supplied to the selected pixels by the scan signals, light corresponding to the data signal is generated by the pixels.

The DC/DC converter uses an external voltage to generate the first voltage and the second voltage, and supplies the first voltage and the second voltage to each pixel.

Such a light emitting display has a problem in that light of different brightness is emitted from each different frame and/or the location of the scan lines to which the pixels connect even when the equivalent data is supplied due to the ripple present in the first voltage.

If the value of current flowing to each light emitting device of such a light emitting display is set differently for each frame when a data signal having an equivalent gradation value is applied, the problem of degraded image quality occurs due to the difference in brightness for each frame.

SUMMARY OF THE INVENTION

Accordingly, it is the aspect of the present invention to provide a DC/DC converter, a light emitting display using the same, and a driving method thereof, and more particularly, to a DC/DC converter, a light emitting display using the same, and a driving method thereof, in which an image is displayed with uniform brightness.

The foregoing and/or other aspects of the present invention are achieved by providing a light emitting display comprising: a pixel portion including a plurality of pixels; a scan driver adapted to supply a scan signal to scan lines connected to the pixels; a DC/DC converter adapted to supply a first voltage and a second voltage to the plurality of pixels; and a synchronizer adapted to maintain a ripple voltage of the first voltage at a predetermined level when the scan signals are converted into a turn off voltage.

The DC/DC converter preferably comprises: an oscillator adapted to generate a pulse signal having a predetermined frequency; a switching controller adapted to alternately turn on and turn off a first switching device and a second switching device to which the pulse signal is supplied; a first voltage generator adapted to generate the first voltage corresponding to a turn on and turn off period; and a second voltage generator adapted to generate the second voltage corresponding to a turn on and turn off period.

The scan driver is adapted to preferably supply at least one scan signal to the synchronizer.

The synchronizer is preferably connected between the oscillator and the switching controller, and is adapted to synchronize the scan signal with the pulse signal, and to supply the synchronized pulse signal to the switching controller. The synchronizer is adapted to synchronize a time when the scan signal is converted into a turn off voltage with a rising edge of the pulse signal. The synchronizer is adapted to synchronize the time when the scan signal is converted into a turn off voltage with a falling edge of the pulse signal.

The light emitting display preferably further comprises a data driver adapted to supply a data signal to data lines connected to the plurality of pixels.

Each of the plurality of pixels preferably comprises: a light emitting device; a first transistor connected between an nth scan line and the data line (where n is a natural number), and adapted to be turned on in response to the scan signal being supplied to the nth scan line; a storage capacitor, connected between the first transistor and the first voltage, and adapted to store a voltage corresponding to the data signal in response to the first transistor being turned on; and a second transistor adapted to supply a current corresponding to the voltage stored in the storage capacitor to the light emitting device.

The light emitting display preferably further comprises: a third transistor, connected between a first voltage and a first transistor, and adapted to be turned on in response to the scan signal being supplied to the (n−1)th scan line; a fourth transistor, connected between a gate electrode of the second transistor and a second electrode of the second transistor, and adapted to be turned on in response to the scan signal being supplied to the (n−1)th scan line; a compensation capacitor, arranged between a gate electrode of the second transistor and the storage capacitor, and adapted to store a voltage corresponding to a threshold voltage of the second transistor in response to the third transistor and the fourth transistor being turned on; and a fifth transistor, arranged between the second transistor and the light emitting device, and adapted to be controlled by an emission control line.

The light emitting display DC/DC converter preferably comprises: an oscillator adapted to supply a pulse signal having a predetermined frequency; a switching controller adapted to turn on and turn off a first switching device in response to receiving the pulse signal; a first voltage generator adapted to generate the first voltage corresponding to a turn on and turn off period of the third transistor; wherein the DC/DC converter is adapted to supply an externally supplied second voltage to the plurality of pixels.

Another aspect of the present invention is achieved by providing a DC/DC converter comprising: an oscillator adapted to generate a pulse signal having a predetermined frequency; a synchronizer adapted to synchronize the pulse signal with an externally supplied scan signal; a switching controller adapted to alternately turn on and turn off the first switching device and the second switching device in response to the pulse signal synchronized by the synchronizer; a first voltage generator adapted to generate a first voltage corresponding to a turn on and turn off period of the first switching device; and a second voltage generator adapted to generate a second voltage corresponding to a turn on and turn off period of the second switching device.

The synchronizer is adapted to preferably synchronize a time when the scan signal is converted into a turn off voltage with a rising edge of the pulse signal.

The synchronizer is adapted to preferably synchronize the time when the scan signal is converted into turn off voltage with a falling edge of the pulse signal.

Still another aspect of the present invention is achieved by providing a method of driving a light emitting display, the method comprising: connecting a plurality of pixels to a scan line to receive a scan signal; connecting the plurality of pixels to a data line to receive a data signal; generating a first pulse signal having a predetermined frequency; generating a second pulse signal by synchronizing the first pulse signal with the scan signal; generating a first voltage and a second voltage using the second pulse signal; and supplying the first voltage and the second voltage to the plurality of pixels.

The second pulse signal is preferably generated by synchronizing a rising edge of the first pulse signal at a time when the scan signal is converted into a turn off voltage.

The second pulse signal is preferably generated by synchronizing a falling edge of the first pulse signal at the time when the scan signal is converted into a turn off voltage.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

Figure 1:
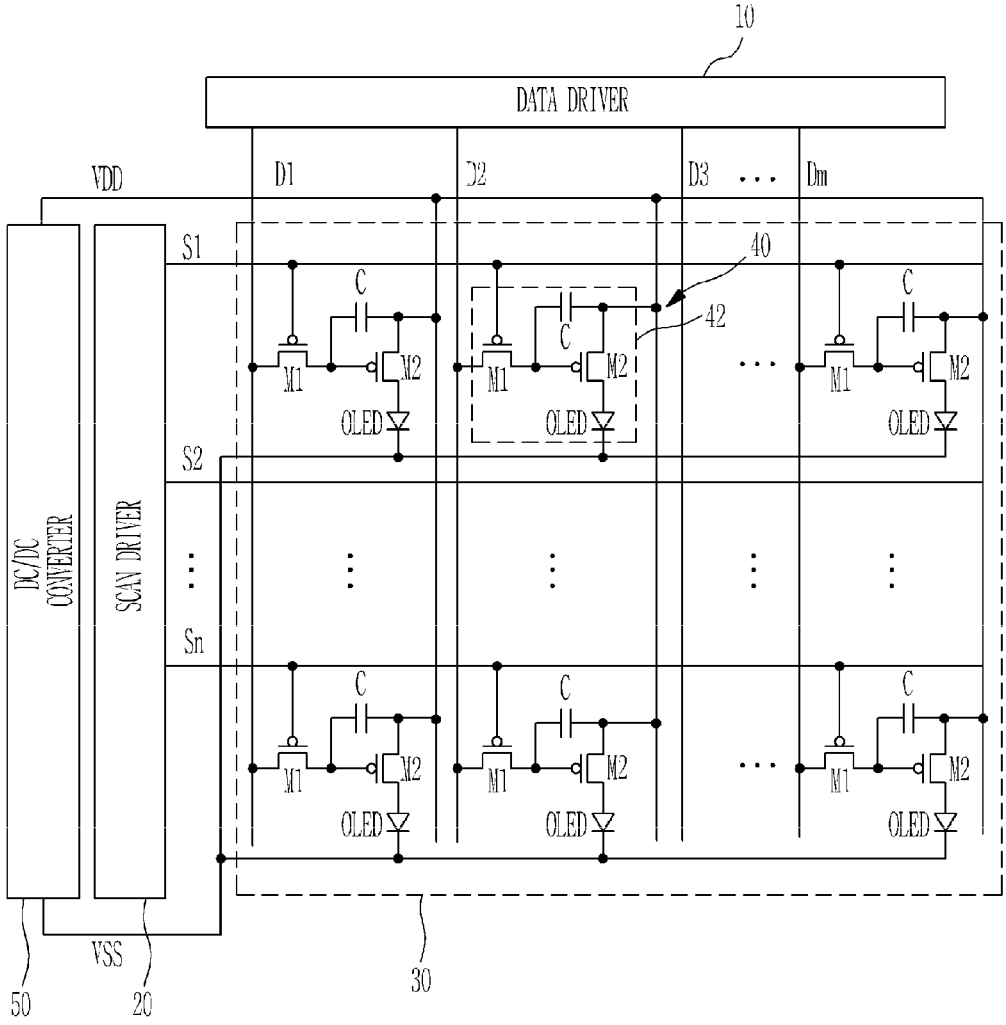
FIG. 1 (PRIOR ART)
FIG. 1 is a view of a light emitting display.
Figure 2:
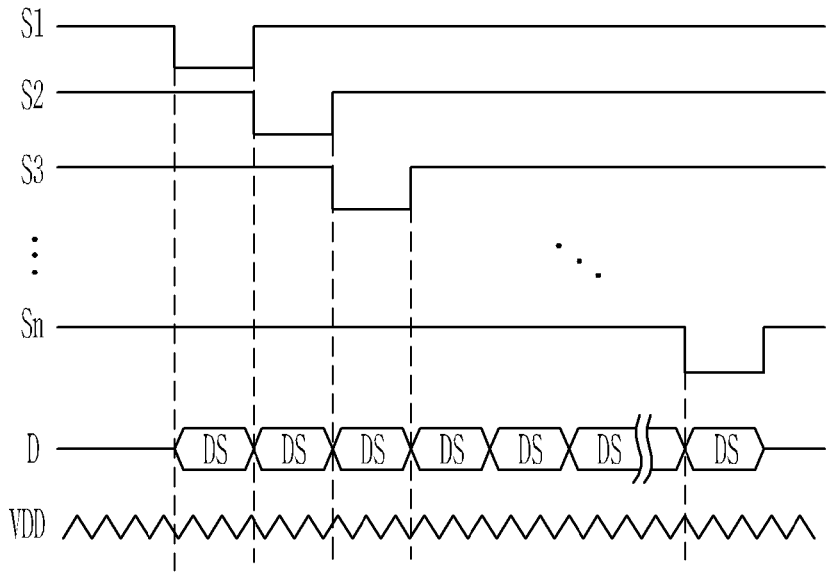
FIG. 2 (PRIOR ART)
FIG. 2 is a view of waveforms of signals for driving the light emitting display of FIG. 1.

FIG. 1 is a view of a light emitting display. FIG. 2 is a view of waveforms of scan signals supplied from a scan driver and a data driver.

Referring to FIGS. 1 and 2, a light emitting display comprises: a pixel portion 30 comprising a plurality of pixels 40 formed adjacent to a region where a plurality of scan lines S1 through Sn intersects a plurality of data lines D1 through Dm (where m is a natural number); a scan driver 20 to drive scan lines S1 through Sn (where n is a natural number); a data driver 10 to drive data lines D1 through Dm; and a DC/DC converter 50 to supply first voltage VDD and second voltage VSS to the pixels 40.

The scan driver 20 generates scan signals and supplies the generated scan signals to the scan lines S1, the first scan line, through Sn, the nth scan line, in sequence. As a result, the pixels 40 are selected in units of horizontal lines in sequence.

The data driver 10 supplies data signals DS to the data lines D1 through Dm when the scan signals are supplied as illustrated in FIG. 2. As a result, as the data signals DS are supplied to the selected pixels 40 by the scan signals, the pixels 40 generate light corresponding to the data signals DS.

The DC/DC converter 50 uses an external voltage (not shown) to generate the first voltage VDD and the second voltage VSS, and supplies the first voltage VDD and the second voltage VSS to each pixel 40.

The pixel portion 30 comprises the plurality of pixels 40. Each pixel 40 supplies current corresponding to the data signals DS to a light emitting device, such as an Organic Light Emitting Diode (OLED), so that a predetermined image is displayed on the pixel portion 30.

Each pixel 40 comprises the light emitting device OLED, and a pixel circuit 42 connected to data lines D and scan lines S and control the light emitting device OLED. The anode of the light emitting device OLED is connected to the pixel circuit 42, and the cathode of the light emitting device OLED is connected to the second voltage VSS. Thus, the light emitting device OLED generates light corresponding to the current supplied by the pixel circuit 42.

The pixel circuit 42 comprises a first transistor M1, a second transistor M2, and a storage capacitor C. The first transistor M1 is turned on when the scan signal is supplied, and the first transistor M1 supplies the data signal to the storage capacitor C. The storage capacitor C stores a voltage corresponding to the data signal when the first transistor is turned on.

The second transistor M2 controls the amount of current flowing from the first voltage VDD to the light emitting device OLED in correspondence with the voltage stored by the storage capacitor C. Light corresponding to the data signal is then generated by the light emitting device OLED.

Figure 3:
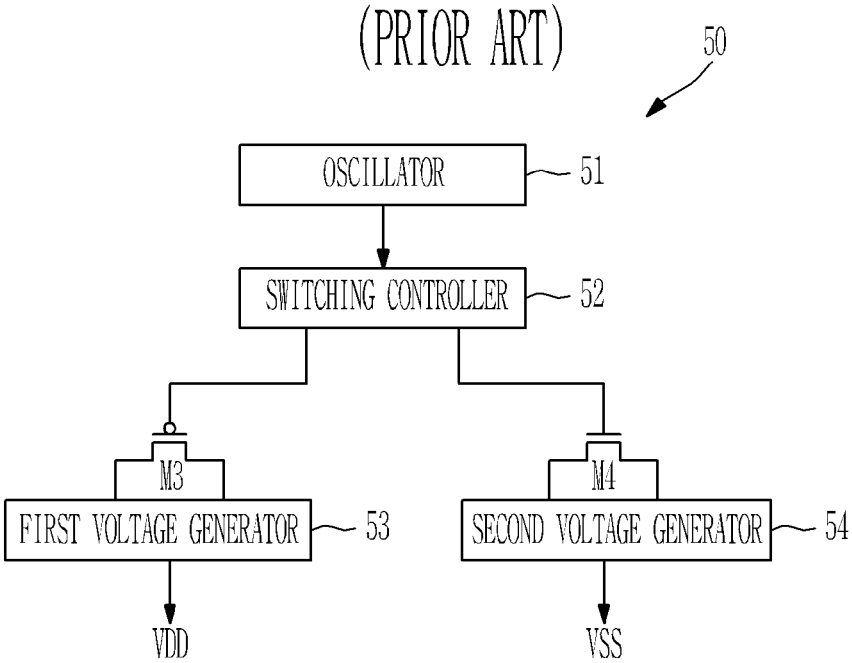
FIG. 3 (PRIOR ART)
FIG. 3 is a block diagram of a DC/DC converter of FIG. 1.

FIG. 3 is a block diagram of the DC/DC converter of FIG. 1.

Referring to FIG. 3, the DC/DC converter 50 comprises an oscillator 51, a switching controller 52, a first voltage generator 53, and a second voltage generator 54.

The oscillator 51 generates pulses having a predetermined frequency and supplies the pulses to the switching controller 52.

The switching controller 52 turns on a third transistor M3 and a fourth transistor M4 alternately in one cycle of each pulse supplied by the oscillator 51.

For a period when the third transistor M3 is turned on and turned off, the first voltage VDD is generated and supplied to the pixels 40. For a period when the fourth transistor M4 is turned on and turned off, the second voltage VSS is generated and supplied to the pixels 40.

However, in the light emitting display described above, there is a problem in that light of different brightness is emitted from each different frame and/or the location of the scan lines to which the pixels connect even when the equivalent data is supplied due to the ripple of the first voltage VDD.

Figure 4:
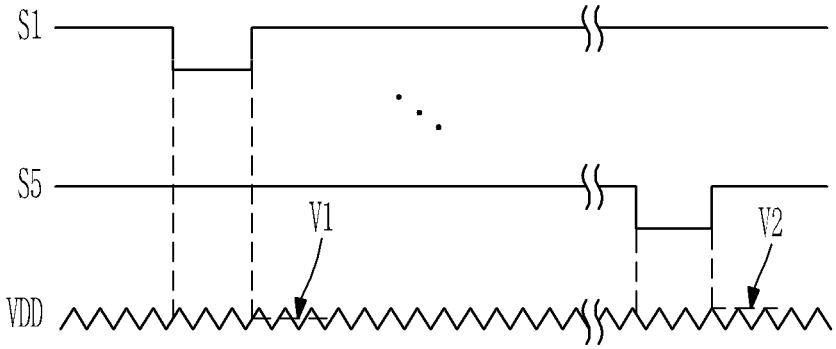
FIG. 4 (PRIOR ART)
FIG. 4 is a view of a ripple effect of the first voltage when a scan signal is converted into a turn off voltage.

Referring to FIG. 4, the first transistor M1 is turned on in response to the scan signal transmitted to the first scan line S1. When the first transistor M1 is turned on, the data signal is supplied to one side of the storage capacitor C, and the first voltage VDD is supplied to other side of the storage capacitor C so that the storage capacitor C stores a predetermined voltage. The value of voltage stored by the storage capacitor C is determined when the first transistor M1 is turned off as the scan signal rises. In other words, the first voltage VDD is set to a predetermined voltage level (for example, it is set to a first voltage V1) by the ripple when the first transistor M1 is turned off, and voltage corresponding to the voltage difference between the first voltage V1 and the data signal is stored by the storage capacitor C.

Similarly, the first transistor M1 connected to a fifth scan line S5 is turned on in response to the scan signal supplied to the fifth scan line S5. When the first transistor M1 is turned on, the data signal is supplied to one side of the storage capacitor C, and because the first voltage VDD is supplied to other side of the storage capacitor C, a predetermined voltage is stored by the storage capacitor C. The value of the voltage stored by the storage capacitor C is determined when the first transistor M1 is turned off as the scan signal rises. In other words, the first voltage VDD is set to a predetermined voltage level (for example, it is set to a second voltage V2) by the ripple when the first transistor M1 is turned off, and voltage corresponding to the voltage difference between the second voltage V2 and the data signal is stored by the storage capacitor C.

In the light emitting display described above, a different voltage is stored by the storage capacitors C in each horizontal line by the ripple of the first voltage VDD, even though the equivalent data signal has been supplied. In other words, even though equivalents data signals have been supplied to the pixels 40 connected to the first scan line S1 and the pixels 40 connected to the fifth scan line S5, because the ripple voltage of the first voltage VDD is set differently when the scan signal is turned off, light having different brightness is emitted. Thus, variations in brightness occur in each frame due to the ripple of the first voltage VDD.

Figure 5:
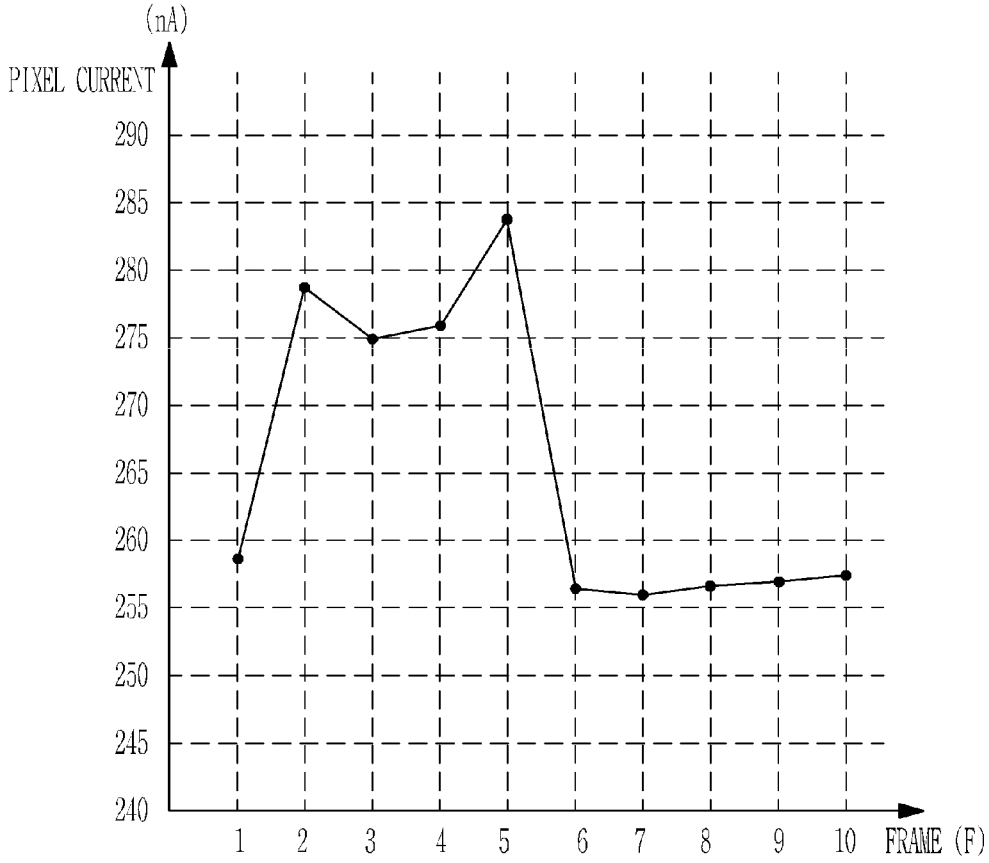
FIG. 5 (PRIOR ART)
FIG. 5 is a graph of the difference in pixel current occurring in frame units caused by the ripple voltage of the first voltage.

FIG. 5 is a graph of the different brightness emitted by each frame.

Referring to FIG. 5, even though the equivalent data signals have been supplied to the same pixels 40, the current flowing to the light emitting device OLED from the pixels 40 is set differently for each frame due to the ripple. Actually, the current flowing from a first frame 1F to the light emitting device OLED is approximately 258.4 nA, the current flowing from a second frame 2F to the light emitting device OLED is approximately 278.3 nA, the current flowing from a third frame 3F to the light emitting device OLED is approximately 275.6 nA, the current flowing from a fourth frame 4F to the light emitting device OLED is approximately 275.8 nA, and the current flowing from a fifth frame 5F to the light emitting device OLED is approximately 284.4 nA. In this way, if the value of current flowing to the light emitting device OLED is set differently for each frame when the data signal having an equivalent gradation value is supplied, the problem of degraded image quality occurs due to the difference in brightness for each frame.

Hereinafter, exemplary embodiments of the present invention are described in detail with reference to the accompanying drawings.

Figure 6:
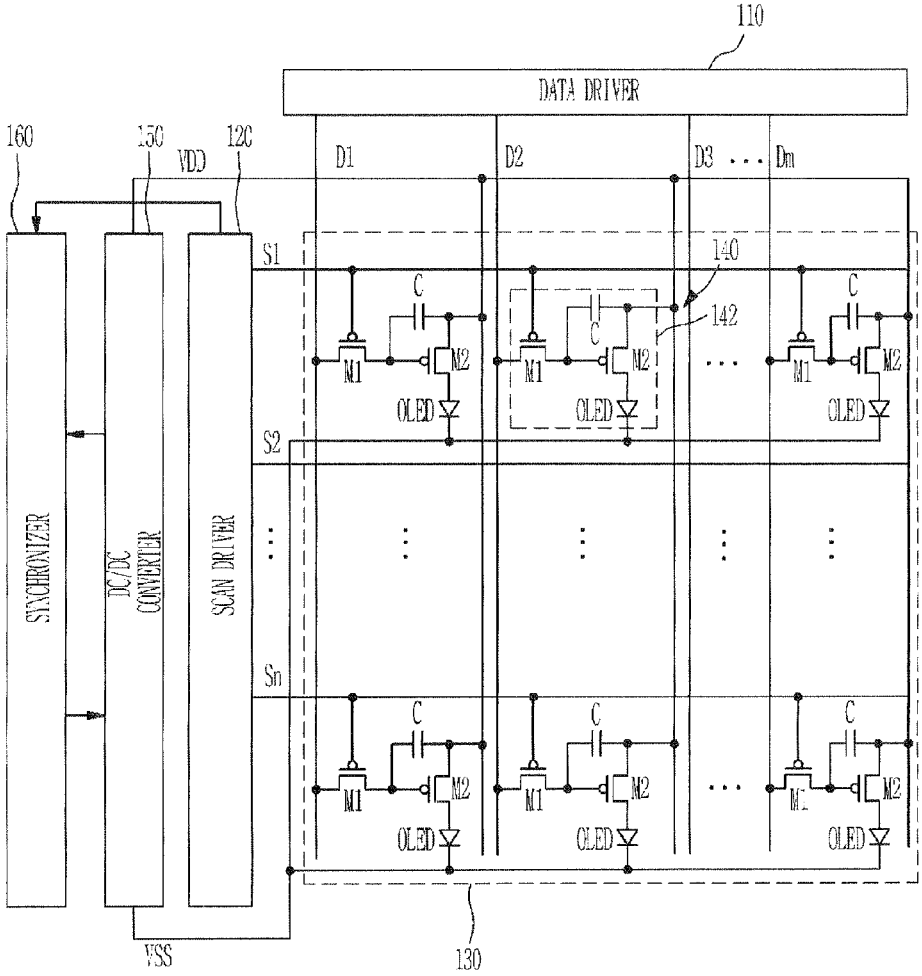
FIG. 6 is a view of a light emitting display according to an embodiment of the present invention.

FIG. 6 illustrates a light emitting display according to a first embodiment of the present invention.

Referring to FIG. 6, a light emitting display according to the first embodiment of the present invention comprises: a pixel portion 130 including pixels 140 formed at an intersecting region of scan lines S1 through Sn and data lines D1 through Dm; a scan driver 120 to drive the scan lines S1 through Sn; a data driver 110 to drive the data lines D1 through Dm; a DC/DC converter 150 to supply a first voltage VDD and a second voltage VSS to the pixels 140; and a synchronizer 160 to maintain the voltage (ripple voltage) of the first voltage VDD when a scan signal rises.

The scan driver 120 generates scan signals and supplies the generated scan signals to the first scan line S1 through the nth scan line Sn in sequence. As a result, the pixels 140 are sequentially selected in units of horizontal lines.

The data driver 110 supplies data signals to the data lines D1 through Dm when the scan signals are supplied. As a result, as the data signals are supplied to the selected pixels 140 in response to the scan signals, the pixels 140 generate light corresponding to the data signals.

The pixel portion 130 comprises the plurality of pixels 140. Each pixel 140 supplies a current corresponding to the data signals to the light emitting device OLED so that a predetermined image is displayed on the pixel portion 130.

Each pixel 140 comprises a light emitting device OLED and a pixel circuit 142, connected to data lines D and scan lines S, to control the light emitting device OLED. An anode of the light emitting device OLED is connected to the pixel circuit 142, and a cathode of the light emitting device OLED is connected to the second voltage VSS. Thus, the light emitting device OLED generates light corresponding to the current supplied from the pixel circuit 142.

The pixel circuit 142 comprises a first transistor M1, a second transistor M2, and a storage capacitor C. The first transistor M1 is turned on when the scan signal is supplied, and the first transistor M1 supplies the data signal to the storage capacitor C. The storage capacitor C stores a voltage corresponding to the data signal when the first transistor M1 is turned on.

The second transistor M2 controls the amount of current flowing from the first voltage VDD to the light emitting device OLED in correspondence with the voltage stored by the storage capacitor C. Light corresponding to the data signal is then generated by the light emitting device OLED.

The DC/DC converter 150 uses an external voltage (not shown) to generate the first voltage VDD and the second voltage VSS, and supplies the first voltage VDD and the second voltage VSS to each pixel 140.

The synchronizer 160 receives at least one scan signal from the scan driver 120. Upon receiving the scan signal, the synchronizer 160 controls the DC/DC converter 150 when the scan signal is converted into a turn off voltage so that the ripple of the first voltage VDD is maintained at a fixed voltage.

Figure 7A:
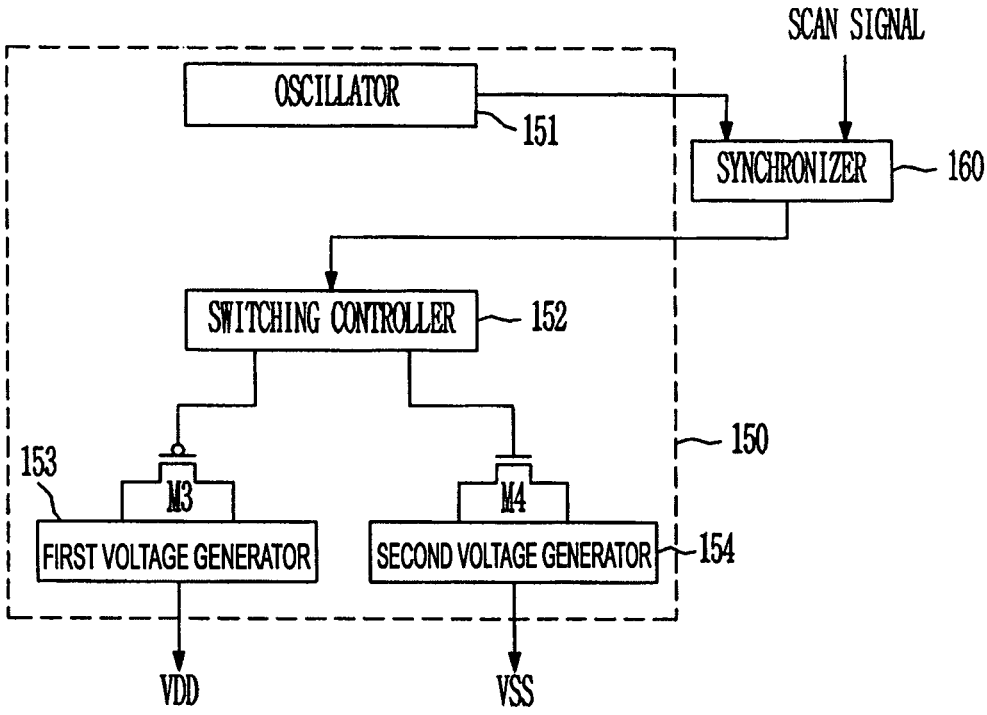
FIGS. 7A through 7C are block diagrams of a DC/DC converter and a synchronizer of the light emitting display of FIG. 6.

FIG. 7A is a block diagram of the DC/DC converter and the synchronizer of FIG. 6.

Figure 7B:
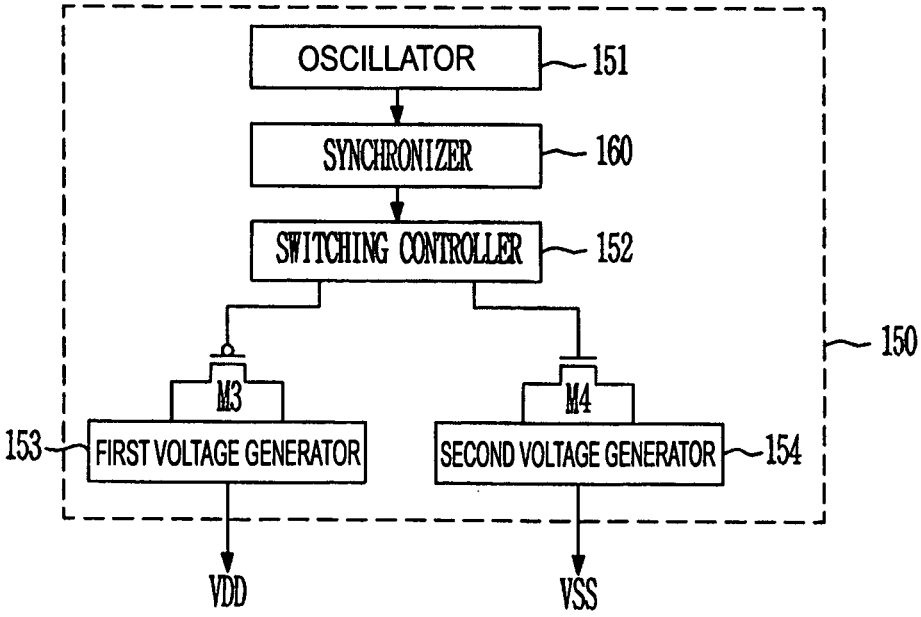
Figure 7C:
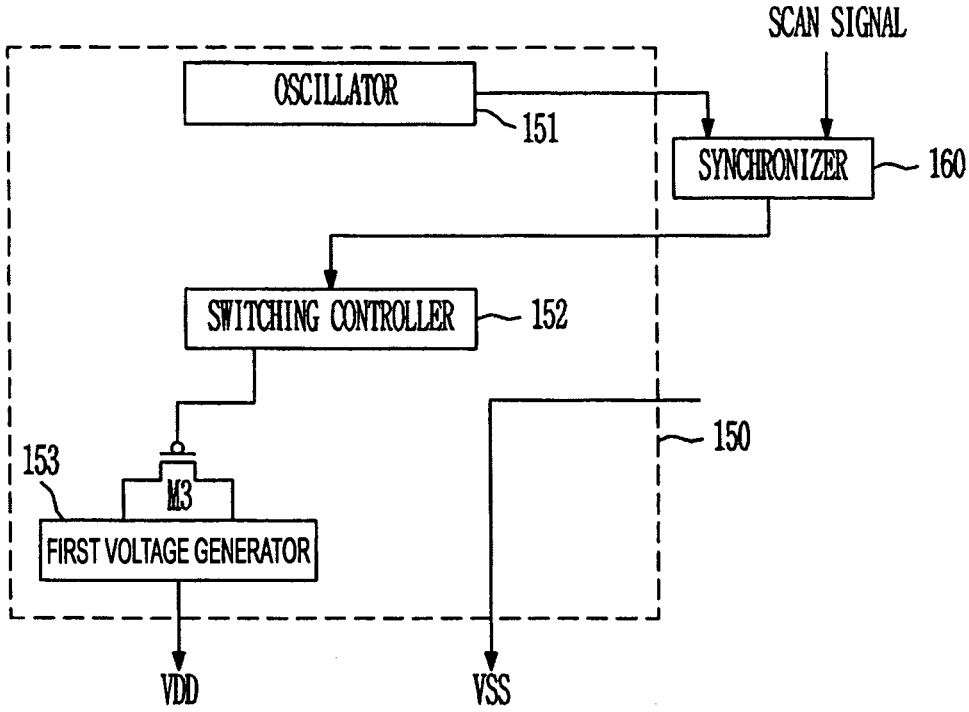

Referring to FIG. 7A, the DC/DC converter 150 of the present invention comprises an oscillator 151, a switching controller 152, a first voltage generator 153 and a second voltage generator 154. The synchronizer 160 is connected between the oscillator 151 and the switching controller 152. In this embodiment, the synchronizer 160 is provided separately from the DC/DC converter 150. Alternatively, the synchronizer 160 can be provided integrally with the DC/DC converter 150 (refer to FIG. 7B). According to an embodiment of the present invention, an external voltage (e.g., a ground voltage) can be used as the second voltage VSS (refer to FIG. 7C).

The oscillator 151 generates pulses having a predetermined frequency and supplies the pulses to the synchronizer 160. The frequency of the pulses generated by the oscillator 151 is preset in consideration of the size of the pixel portion 130, resolution, etc.

The scan driver 120 supplies the scan signal to the synchronizer 160, and the oscillator 151 supplies the pulse signal having a predetermined frequency to the synchronizer 160. The synchronizer 160, which is supplied the scan signal and the pulse signal, synchronizes the scan signal with the pulse signal and supplies the synchronized pulse signal to the switching controller 152.

Figure 8A:
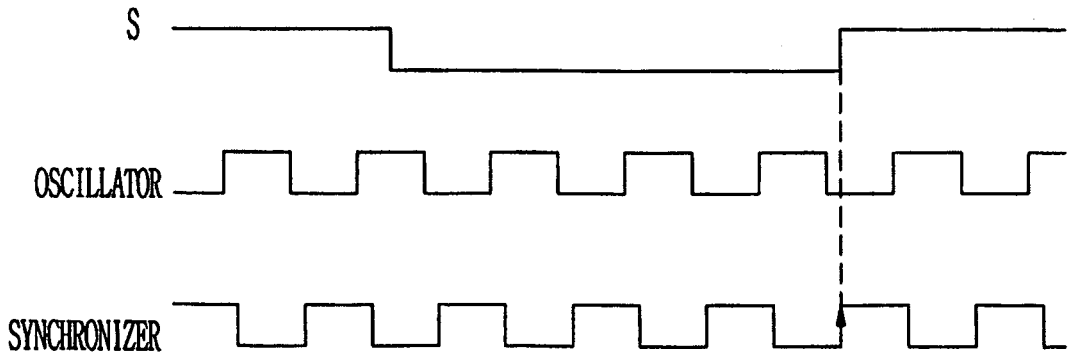
FIGS. 8A and 8B are waveforms of synchronizing a pulse signal and a scan signal in the synchronizer.
Figure 8B:
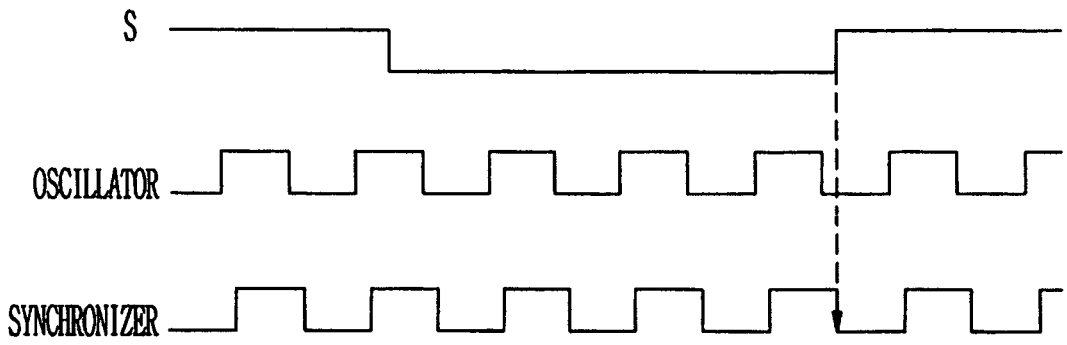

To explain in detail, the synchronizer 160, which is supplied at least one scan signal and pulse signal, synchronizes timing when the scan signal is converted into a turn off voltage with a rising edge of the pulse signal as illustrated in FIG. 8A. In other words, the synchronizer 160 synchronizes the scan signal with the rising edge of the pulse signal and supplies the synchronized pulse signal to the switching controller 152. As illustrated in FIG. 8B, the synchronizer 160 is capable of synchronizing the timing when the scan signal is converted into a turn off voltage with a falling edge of the pulse signal.

The switching controller 152 is supplied the pulse signal synchronized with the scan signal by the synchronizer 160. The switching controller 152, which is supplied the pulse signal, alternately turns on a third transistor M3 (or a first switching device) and a fourth transistor M4 (or a second switching device) in one cycle of the pulse signal.

the first voltage VDD is generated and supplied to the pixels 140 during the period when the third transistor M3 is turned on or turned off. The second voltage VSS is generated and supplied to the pixels 140 during the period when the fourth transistor M4 is turned on or turned off.

Since the DC/DC converter 150 of the present invention synchronizes the rising edge or the falling edge of the pulse signal at the time when the scan signal is converted into a turn off voltage, the ripple voltage of the first voltage VDD is always kept constant when the scan signal is converted into a turn off voltage.

Figure 9:
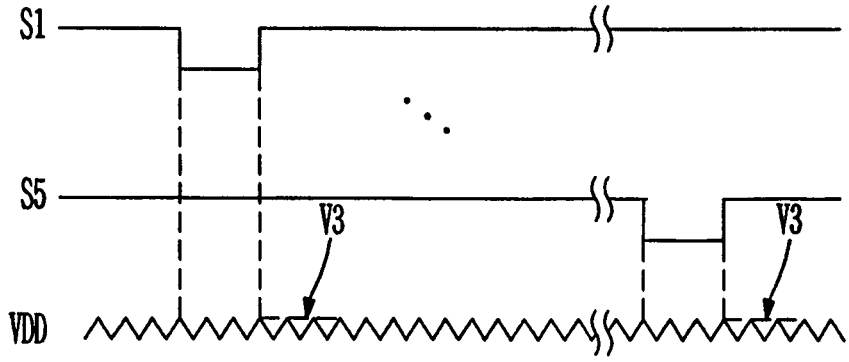
FIG. 9 is a view of the ripple voltage of the first voltage when the scan signal is converted into a turn off voltage.

Referring to FIG. 9, the first transistor M1 is turned on in response to the scan signal transmitted to the first scan line S1. When the first transistor M1 is turned on, the data signal is supplied to one side of the storage capacitor C, and the first voltage VDD is supplied to other side of the storage capacitor C so that the storage capacitor C stores a predetermined voltage. The voltage to be stored by the storage capacitor C is determined when the first transistor M1 is turned off as the scan signal rises. In other words, the first voltage VDD is set to a third voltage V3 by the ripple when the first transistor M1 is turned off, and voltage corresponding to the voltage difference between the third voltage V3 and the data signal is stored by the storage capacitor C.

Similarly, the first transistor M1 connected to a fifth scan line S5 is turned on in response to the scan signal supplied to the fifth scan line S5. When the first transistor M1 is turned on, the data signal is supplied to one side of the storage capacitor C, and because the first voltage VDD is supplied to other side of the storage capacitor C, a predetermined voltage is stored by the storage capacitor C. The value of voltage stored by the storage capacitor C is determined when the first transistor M1 is turned off as the scan signal rises. In other words, the first voltage VDD is set to the third voltage V3 by the ripple when the first transistor M1 is turned off, and a voltage corresponding to the voltage difference between the third voltage V3 and the data signal is stored by the storage capacitor C.

That is, in the present invention, since the pulse signal generated by the oscillator 151 is synchronized with the scan signal, the ripple voltage of the first voltage VDD (for example, the third voltage V3) is always kept constant when the scan signal is converted into a turn off voltage. Accordingly, in the present invention, since the equivalent signal is supplied, light having the same brightness is generated by the line units, and accordingly, a uniform brightness is achieved. Furthermore, in the present invention, the ripple voltage of the first voltage VDD is always kept constant when the scan signal is converted into a turn off voltage, and therefore, a difference in brightness does not occur.

Figure 10:
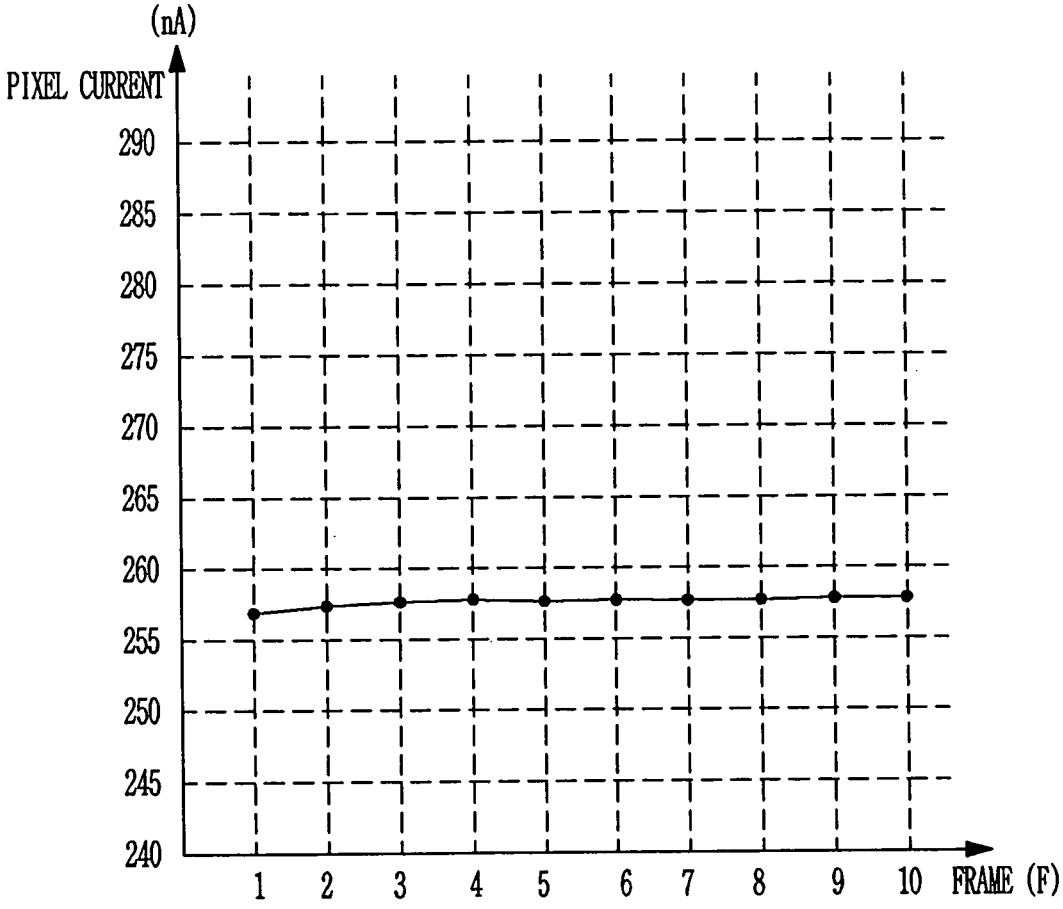
FIG. 10 is a graph of the pixel current generated in frame units when the data signal corresponding to the equivalent gradation level is supplied.

FIG. 10 illustrates current supplied to the light emitting device OLED when the data signal having the same gradation per frame is supplied.

Referring to FIG. 10, a current whose value remains almost the same is supplied to the light emitting device OLED in each frame when the data signal having the same gradation is supplied to the pixels 140 in an embodiment of the present invention.

TABLE 1

| Frame | 1F | 2F | 3F | 4F | 5F | 6F | 7F | 8F | 9F | 10F |
|---|---|---|---|---|---|---|---|---|---|---|
| Pixel current | 256.2 | 256.6 | 257.3 | 257.4 | 256.8 | 257.0 | 257.0 | 257.0 | 257.0 | 257.0 |

In other words, in the present invention, since the ripple voltage of the first voltage VDD is always kept constant when the scan signal is converted into a turn off voltage, the current flowing to the light emitting device OLED of the pixels 140 is set almost the same for each frame as illustrated in Table 1 when the data signal having the same gradation is supplied.

The structure of the pixel 140 can be set in various ways according to an embodiment of the present invention. For example, the structure of the pixel 140 of the present invention can be set as illustrated in FIG. 11.

Figure 11:
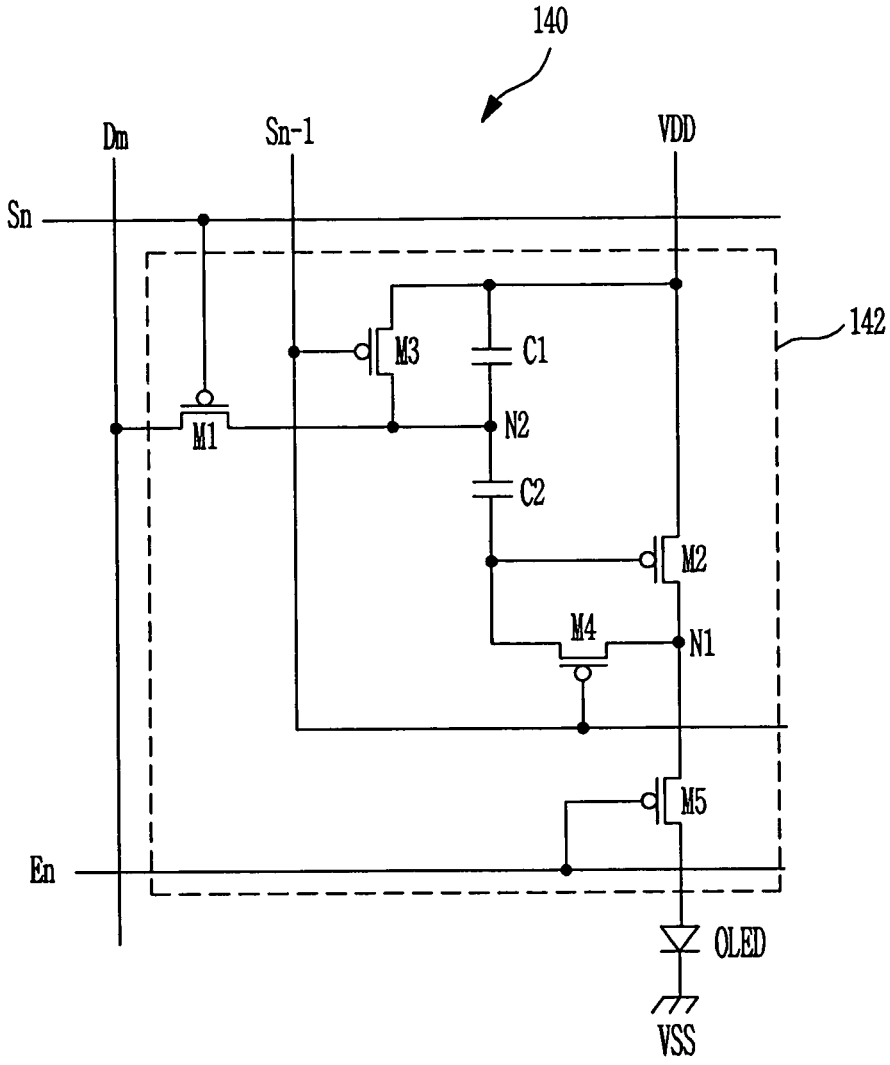
FIG. 11 is a circuit diagram of a pixel according to another embodiment of the present invention.

FIG. 11 is a circuit diagram of the structure of the pixel according to an embodiment.

Referring to FIG. 11, the pixel 140 according to an embodiment of the present invention comprises the light emitting device OLED, the data line Dm, the scan line Sn, and the pixel circuit 142 connected to an emission control line En and the light emitting device OLED.

The anode of the light emitting device OLED is connected to the pixel circuit 142, and the cathode is connected to the second voltage VSS. The second voltage VSS is set to a lower voltage than the first voltage VDD, such as a ground voltage, etc.

The pixel circuit 142 comprises the first transistor M1 connected to the scan line Sn and the data line Dm; the second transistor M2 connected between the first voltage VDD and the light emitting device OLED; the emission control line En;

a fifth transistor M5 connected to the light emitting device OLED and the second transistor M2; the third transistor M3 connected to the first transistor M1, the first voltage VDD and a (n−1)th scan line Sn-1; a fourth transistor M4 connected to a first node N1, the (n−1)th scan line Sn-1 and the second transistor M2; a storage capacitor Cst connected between a second node and the first voltage VDD; and a compensation capacitor C2 connected between the second node and a gate electrode of the second transistor M2. The transistors M1 through M5 are illustrated as p-type transistors in FIG. 11. However, the present invention is not limited thereto.

A gate electrode of the first transistor M1 is connected to the nth scan line Sn, and a first electrode of the first transistor M1 is connected to the data line Dm. A second electrode of the first transistor M1 is connected to a second node N2. For example, if the first electrode is set as a source electrode, then the second electrode is set as a drain electrode, and if the first electrode is set as the drain electrode, then the second electrode is set as the source electrode. The first transistor M1 is turned on when the scan signal is supplied to the nth scan line Sn, and supplies the data signal to the second node N2 from the mth data line Dm.

A gate electrode of the third transistor M3 is connected to the (n−1)th scan line Sn-1, and a first electrode of the third transistor M3 is connected to the first voltage VDD. A second electrode of the third transistor M3 is connected to the second node N2. The third transistor M3 supplies the voltage from the first voltage VDD to the second node N2 when the scan signal is supplied to the (n−1)th scan line Sn-1.

A gate electrode of the fourth transistor M4 is connected to the (n−1)th scan line Sn-1, and a first electrode of the fourth transistor M4 is connected to the gate electrode of the second transistor M2. A second electrode of the fourth transistor M4 is connected to the first node N1. The fourth transistor M4 connects the gate electrode of the second transistor M2 to the first node N1 when the scan signal is supplied to the (n−1)th scan line Sn-1.

A storage capacitor C1 stores a voltage corresponding to the data signal supplied to the second node N2 when the scan signal is supplied to the nth scan line Sn, and maintains the stored voltage for one frame.

The compensation capacitor C2 stores a voltage corresponding to threshold voltage Vth of the second transistor M2 when the scan signal is supplied to the (n−1)th scan line Sn-1. The voltage stored by the compensation capacitor C2 is used to compensate the threshold voltage Vth of the driving TFT (DT).

The gate electrode of the second transistor M2 is connected to a first electrode of the fourth transistor M4 and the compensation capacitor C2, and a first electrode of the second transistor M2 is connected to the first voltage VDD. A second electrode of the second transistor M2 is connected to the first node N1. The second transistor M2 controls the current flowing to the first node N1 from the first voltage VDD in correspondence with the voltage supplied to its own gate electrode.

A gate electrode of the fifth transistor M5 is connected to an nth emission control line En, and a first electrode of the fifth transistor M5 is connected to the first node N1. A second electrode of the fifth transistor M5 is connected to an anode electrode of the light emitting device OLED. Corresponding to an emission control signal supplied to the nth emission control line En, the fifth transistor M5 controls the timing of supplying of the current to the light emitting device OLED from the second transistor M2.

To explain in detail about operations of the pixels 142, the scan signal is supplied to the (n−1)th scan line Sn-1, and the emission control signal is supplied to the nth emission control line En. The fifth transistor M5 is turned off when the emission control signal is supplied to the nth emission control line En. The third and the fourth transistors M3 and M4 are turned on when the scan signal is supplied to the (n−1)th scan line Sn-1. The second transistor M2 is connected like a diode when the third and the fourth transistors M3 and M4 are turned on, and thus a compensation voltage corresponding to the threshold voltage of the second transistor M2 is stored by the compensation capacitor C2.

Then, the scan signal is supplied to the nth scan line Sn. The first transistor M1 is turned on when the scan signal is supplied to the nth scan line Sn. The data signal supplied to the mth data line Dm is supplied to the second node N2 via the first transistor M1 when the first transistor M1 is turned on. The voltage corresponding to the data signal is stored by the storage capacitor C1 when the data signal is supplied to the second node N2. The voltage stored by the storage capacitor C1 and the voltage stored by the compensation capacitor C2 are combined and supplied to the gate electrode of the second transistor M2. Then, corresponding to the voltage supplied to its own gate electrode, the second transistor M2 controls the current flowing to the fifth transistor M5 from the first voltage VDD.

Then, the emission control signal is not supplied to the nth emission control line En. Then, the fifth transistor M5, turned on, supplies the current, supplied from the second transistor M2, to the light emitting device OLED, and the light corresponding to the light emitting device OLED is generated accordingly.

In the pixels of an embodiment of the present invention, the current corresponding to the threshold voltage Vth of the second transistor M2 is stored in the compensation capacitor C2, compensates the threshold voltage of the second transistor M2, and therefore, a uniform brightness is displayed. Furthermore, since the ripple voltage of the first voltage VDD is always kept constant when the scan signal is turned off, a uniform brightness in units of horizontal line and in units of frame can be displayed.

Although exemplary embodiments of the present invention have been shown and described, it would be appreciated by those skilled in the art that modifications can be made to these embodiments without departing from the principles and spirit of the invention, the scope of which is defined in the following claims.

What is claimed is:

1. A light emitting display device, comprising:

a pixel portion including a plurality of pixels, each pixel comprising a second transistor and an organic light emitting diode (OLED), with one of source and drain electrodes of the second transistor being connected to an anode of the OLED;

a scan driver adapted to supply scan signals to scan lines connected to a gate electrode of a first transistor included in each of the plurality of pixels and to supply at least one scan signal to a synchronizer;

a data driver adapted to supply data signals to data lines connected to the plurality of pixels;

a DC/DC converter adapted to supply a first voltage different from the scan and data signals directly to another one of source and drain electrodes of the second transistor included in each of the plurality of pixels and to supply a second voltage to a cathode of the OLED included in each of the plurality of pixels; and the synchronizer adapted to, when the scan signals are converted into a turn off voltage, maintain a ripple voltage of the first voltage at a predetermined level.

2. The light emitting display device according to claim 1, wherein the DC/DC converter comprises:

an oscillator adapted to generate a pulse signal having a predetermined frequency;

a switching controller adapted to alternately turn on and turn off a first switching device and a second switching device to which the pulse signal is supplied;

a first voltage generator adapted to generate the first voltage corresponding to a turn on and turn off period; and a second voltage generator adapted to generate the second voltage corresponding to a turn on and turn off period.

3. The light emitting display device according to claim 1, wherein the synchronizer is connected between the oscillator and the switching controller, and is adapted to synchronize the scan signal with the pulse signal, and to supply the synchronized pulse signal to the switching controller.

4. The light emitting display device according to claim 3, wherein the synchronizer is adapted to synchronize a time when the scan signal is converted into a turn off voltage with a rising edge of the pulse signal.

5. The light emitting display device according to claim 3, wherein the synchronizer is adapted to synchronize the time when the scan signal is converted into a turn off voltage with a falling edge of the pulse signal.

6. The light emitting display device according to claim 1, wherein each of the plurality of pixels comprises:

the OLED;

the first transistor connected between an nth scan line and the data line (where n is a natural number), and adapted to be turned on in response to the scan signal being supplied to the nth scan line;

a storage capacitor, connected between the first transistor and the first voltage, and adapted to store a voltage corresponding to the data signal in response to the first transistor being turned on; and the second transistor adapted to supply a current corresponding to the voltage stored in the storage capacitor to the OLED.

7. The light emitting display device according to claim 6, further comprising:

a third transistor, connected between the first voltage and the first transistor, and adapted to be turned on in response to the scan signal being supplied to the (n−1)th scan line;

a fourth transistor, connected between a gate electrode of the second transistor and a second electrode of the second transistor, and adapted to be turned on in response to the scan signal being supplied to the (n−1)th scan line;

a compensation capacitor, arranged between a gate electrode of the second transistor and the storage capacitor, and adapted to store a voltage corresponding to a threshold voltage of the second transistor in response to the third transistor and the fourth transistor being turned on; and a fifth transistor, arranged between the second transistor and the light emitting device, and adapted to be controlled by an emission control line.

8. The light emitting display device according to claim 1, wherein the DC/DC converter comprises:

an oscillator adapted to supply a pulse signal having a predetermined frequency;

a switching controller adapted to turn on and turn off a first switching device in response to receiving the pulse signal;

a first voltage generator adapted to generate the first voltage corresponding to a turn on and turn off period of the first switching device;

wherein the DC/DC converter is adapted to supply an externally supplied second voltage to the plurality of pixels.

9. A DC/DC converter, comprising:

a first switching device and a second switching device physically distinct from the first switching device;

an oscillator adapted to generate a pulse signal having a predetermined frequency;

a synchronizer adapted to synchronize the pulse signal with an externally supplied scan signal;

a switching controller adapted to alternately turn on and turn off the first switching device and the second switching device in response to the pulse signal synchronized by the synchronizer within one cycle of the pulse signal;

a first voltage generator adapted to generate a first voltage corresponding to a turn on and turn off period of the first switching device, with the first voltage being different from the scan signal;

a second voltage generator adapted to generate a second voltage corresponding to a turn on and turn off period of the second switching device, with the second voltage being different from the scan signal; and the first switching device controlling the generation of the first voltage by the first voltage generator independently of the control of the generation of the second voltage by the second voltage generator, and the second switching device controlling the generation of the second voltage by the second voltage generator independently of the control of the generation of the first voltage by the first voltage generator.

10. The DC/DC converter according to claim 9, wherein the synchronizer is adapted to synchronize a time when the scan signal is converted into a turn off voltage with a rising edge of the pulse signal.

11. The DC/DC converter according to claim 9, wherein the synchronizer is adapted to synchronize the time when the scan signal is converted into turn off voltage with a falling edge of the pulse signal.

12. A light emitting display device having a DC/DC converter of claim 9, said light emitting display comprising:

a pixel portion including a plurality of pixels;

a scan driver adapted to supply the scan signals to scan lines connected to the pixels;

the synchronizer coupled to maintain a ripple voltage of the first voltage at a predetermined level when the scan signals are converted into a turn off voltage;

the first voltage generator coupled to supply the first voltage to the plurality of pixels; and the second voltage generator coupled to supply the second voltage to the plurality of pixels.

13. A light emitting display device having a DC/DC converter of claim 9, said light emitting display comprising:

a pixel portion including a plurality of pixels, each comprising:

a light emitting device;

a first transistor connected between an nth scan line and the data line, where n is a natural number, and adapted to be turned on in response to the scan signal being supplied to the nth scan line;

a storage capacitor, connected between the first transistor and the first voltage, and adapted to store a voltage corresponding to the data signal in response to the first transistor being turned on; and a second transistor adapted to supply a current corresponding to the voltage stored in the storage capacitor to the light emitting device;

a scan driver adapted to supply the scan signals to scan lines connected to the pixels;

the synchronizer coupled to maintain a ripple voltage of the first voltage at a predetermined level when the scan signals are converted into a turn off voltage;

the first voltage generator coupled to supply the first voltage to the plurality of pixels; and the second voltage generator coupled to supply the second voltage to the plurality of pixels.

14. A method of driving a light emitting display device, the method comprising:

connecting one of source and drain electrodes of a first transistor included in each of a plurality of pixels to an anode of an organic light emitting diode (OLED) included in each of the plurality of pixels;

connecting a gate electrode of a second transistor included in each of a plurality of pixels to a scan line to receive a scan signal;

connecting the plurality of pixels to a data line to receive a data signal;

driving an oscillator to generate a first pulse signal having a predetermined frequency;

generating a second pulse signal by synchronizing the first pulse signal with the scan signal;

generating a first voltage different from the scan and data signals and a second voltage using the second pulse signal; and supplying the first voltage directly to another one of source and drain electrodes of the first transistor included in each of the plurality of pixels and supplying the second voltage to a cathode of the OLED included in each of the plurality of pixels, wherein the second pulse signal is generated by synchronizing a rising edge or a falling edge of the first pulse signal at a time when the scan signal is converted into a turn off voltage.

15. A light emitting display device according to claim 14, comprising:

a pixel portion including the plurality of pixels;

the scan line comprising a plurality of scan lines connected to the pixels;

a scan driver adapted to supply the scan signal to the scan lines;

a DC/DC converter adapted to supply the first voltage and the second voltage to the plurality of pixels; and a synchronizer adapted to maintain a ripple voltage of the first voltage at a predetermined level when the scan signal is converted into a turn off voltage.

16. A light emitting display device according to claim 14, comprising:

the scan line being comprised of a plurality of scan lines connected to the pixels;

a scan driver adapted to supply the scan signal to the scan lines;

each of the plurality of pixels being comprised of:

the OLED;

the second transistor connected between an nth scan line and the data line, where n is a natural number, and adapted to be turned on in response to the scan signal being supplied to the nth scan line;

a storage capacitor, connected between the first transistor and the first voltage, and adapted to store a voltage corresponding to the data signal in response to the first transistor being turned on; and the first transistor adapted to supply a current corresponding to the voltage stored in the storage capacitor to the OLED;

a DC/DC converter coupled to supply the first voltage and the second voltage to the plurality of pixels; and a synchronizer coupled to maintain a ripple voltage of the first voltage at a predetermined level when the scan signal is converted into a turn off voltage.

* * * * *